United States Patent [19]

Akashi

[11] Patent Number: 4,974,297

[45] Date of Patent: Dec. 4, 1990

[54] SLIDER PULL TAB FOR SLIDE FASTENER

[75] Inventor: Shunji Akashi, Kurobe, Japan

[73] Assignee: Yoshida Kogyo K. K., Tokyo, Japan

[21] Appl. No.: 434,430

[22] Filed: Nov. 13, 1989

[30] Foreign Application Priority Data

Nov. 17, 1988 [JP] Japan ..... 63-150311[U]

[51] Int. Cl.[5] ..... A44B 19/30

[52] U.S. Cl. ..... 24/429; 24/419; 24/431

[58] Field of Search ..... 24/429, 419, 430, 431

[56] References Cited

U.S. PATENT DOCUMENTS

| | | | |
|---|---|---|---|
| D. 96,158 | 7/1935 | Carlile | 24/429 |
| 1,752,111 | 3/1930 | Rutherford . | |
| 2,019,220 | 10/1935 | Gammons | 24/419 |
| 2,145,118 | 1/1939 | Knoess | 24/429 |
| 2,185,853 | 1/1940 | Knoess | 24/429 |
| 3,028,647 | 4/1962 | Greenberg . | |
| 3,641,634 | 2/1972 | Asai | 24/429 |
| 3,754,306 | 8/1973 | Cirone . | |
| 4,704,770 | 11/1987 | Minami et al. | 24/431 |
| 4,790,050 | 12/1988 | Ishii | 24/429 |

FOREIGN PATENT DOCUMENTS

| | | | |
|---|---|---|---|
| 8002494 | 11/1980 | European Pat. Off. | 24/429 |
| 0287060 | 10/1988 | European Pat. Off. . | |
| 1234080 | 4/1964 | Fed. Rep. of Germany . | |
| 1479519 | 3/1966 | France . | |
| 1531615 | 7/1968 | France | 24/431 |
| 2069317 | 8/1981 | United Kingdom . | |
| 2182977 | 11/1986 | United Kingdom . | |

*Primary Examiner*—Victor N. Sakran

*Attorney, Agent, or Firm*—Hill, Van Santen, Steadman & Simpson

[57] ABSTRACT

A slider pull tab for slide fastener is disclosed, which comprises a clamper portion formed from a metallic material and a finger-grip portion connected thereto, the finger-grip portion being formed from a transparent or semi-transparent synthetic resin into a tongue-like web and including at least in part a transparent see-through region and a decorative region engraved in the lower surface of the finger portion.

7 Claims, 2 Drawing Sheets

SLIDER PULL TAB FOR SLIDE FASTENER

BACKGROUND OF THE INVENTION

Field of the Invention

This invention relates to sliders for slide fasteners and more particularly to a pull tab operatively associated with such a slider for opening and closing the slide fastener.

Slide fasteners have found wide application as a convenient means of opening and closing compliant garment articles and bags. The types and designs of slide fasteners have been contrived so as to be compatible with the various design and ornamental features that evolve from time to time in the garment products to which the slide fasteners are applied. Due to their functional limitations, however, slide fasteners per se warrant only little modification or changes in their basic construction and configuration. Therefore, the most practical approach which has prevailed thus far was to provide slide fastener component parts such as stringer tapes, fastener elements and sliders with certain colors acceptable to the specification of each particular garment or bag item. Advanced notion has recently been embodied in the ornamental design of slider pull tabs which represents compatibility with the particular garment article to which the slide fastener is applied. A pull tab for slider is relatively small in size but visually stands out very much like a pendant, and it can be widely varied in both structural and ornamental designs. Slider pull tabs may be formed from metals, plastics material or artificial leather and shaped into different design configurations, engraved, sculptured in relief or otherwise decorated.

There have been proposed many such decorative contrivances in the art, but most of them still have a little more to be desired to meet with the trend of highly fashionable garment articles.

SUMMARY OF THE INVENTION

It is therefore the primary object of the present invention to provide a slider pull tab for slide fastener which incorporates means of providing enhanced aethetic appeal thereby contributing to greater ornamental attractiveness of a given garment article to which the slide fastener is applied.

The invention has been achieved basically by the use of a transparent or semi-transparent material for a slider pull tab. It has however been found that no significant improvement is expected by merely applying such transparent material to a plate-like pull tab body which is formed mostly flat to facilitate finger-grip movement of the slider.

According to the invention, there is provided a slider pull tab for slide fastener which comprises a clamper portion and a finger-grip portion connected thereto, the finger-grip portion being formed from a transparent synthetic resin and including at least in part a transparent see-through region and a decorative region engraved in the lower surface of the finger portion.

The invention will now be described in detail with reference to the accompanying drawings which illustrate by way of example some preferred embodiments. Like reference numerals refer to like or corresponding parts throughout the several views.

DETAILED DESCRIPTION OF THE PREFERRED EMBODIMENT

Figure 1:
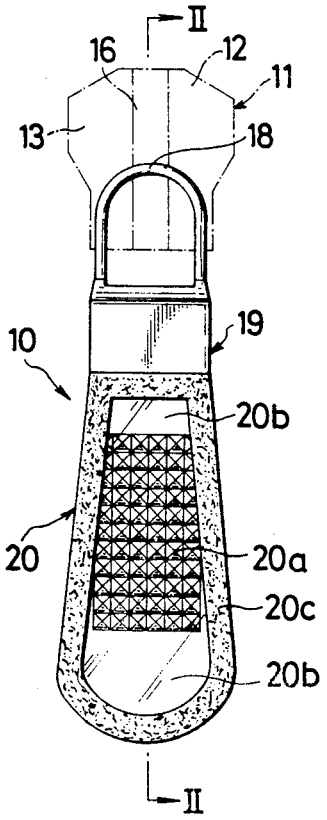
FIG. 1 is a plan view of a slider pull tab embodying the invention, with a slider body indicated in phantom line.

Referring now to the drawings and FIG. 1 in particular, there is shown a slider pull tab 10 embodying the invention which is operatively associated with a slider 11 for moving the latter reciprocally to open and close a slide fastener (not shown). The slider 11 indicated in phantom line is conventional, comprising a slider body 12 including an upper wing member 13 and a lower wing member 14 joined together at one of their respective ends and defining therebetween a guide channel 15 for the passage of slide fastener stringers. A support lug 16 formed on the upper wing member 13 has an opening 17 in which a connector ring 18 is received for pivotal movement of the pull tab 10.

The slider pull tab 10 comprises a clamper portion 19 and a finger-grip portion 20 connected thereto in a manner hereinafter to be described.

The clamper portion 19 is formed from a suitable metallic material into a generally rectangular block which has an elongate slot **19*a* extending longitudinally of the pull tab 10 and a window 19*b* formed in the lower surface of the block in communication with the slot 19*a***.

The finger-grip portion 20 is formed from a transparent or semi-transparent synthetic resin into a generally tongue-like web which increases in thickness progressively toward its free end opposite to the clamper portion 19. The transparent or semi-transparent synthetic resin forming the web or finger-grip portion 20 of the pull tab 10 may be selected suitably from the group of acryl resin, polycarbonate resin, nylon resin and the like. The finger-grip portion 20 includes a decorative region **20*a* which occupies the majority of the finger-grip portion 20, upper and lower transparent see-through regions 20*b* located on opposite ends of the decorative region 20*a* and an opaque marginal region 20*c* formed on the upper surface of the finger-grip portion 20 and surrounding the decorative and transparent regions (20*a*) and (20*b*). The opaque region 20*c* may be formed from synthetic resins which are similar to those for the finger-grip portion 20 but which are importantly non-transparent to accentuate contrast with the decorative region 20*a* and the transparent regions 20*b***.

The finger-grip portion 20 is formed preferably by means of biaxial injection-molding in which a lower half of the portion 20 including the decorative region **20*a* and the transparent regions 20*b*** is first formed, followed by superimposed injection thereover of a non-transparent resinous material.

The non-transparent region **20*c* may be alternatively provided in the form of lines traversing the center of the finger-grip portion 20** visually bifurcating the latter.

The decorative region **20*a* is formed by engraving a suitable design pattern or mark in the lower surface 20*d* of the finger-grip portion 20 as presently illustrated whereby there is produced a light-reflective, stereographic effect to make the pull tab 10 highly ornamentally attractive. This effect is further enhanced by the provision of the non-transparent marginal region 20***c* bordering the finger-grip portion 20. As better shown in FIGS. 2 and 4, the pull tab 10 has a snap lock prong 21 formed integrally at one of its ends and adapted to engage snappingly in the window 19*b* of the clamper portion 19 when the pull tab 10 is inserted in place through the slot 19*a*. At the opposite end of the pull tab 10 is formed a downwardly projecting lug 22 serving as a stop for hook engagement with a finger of the pull tab operator to prevent slippage.

Slip-free provision is also realized by the presence of the decorative region 20*a* which has engraved, hence coarse undersides. Whereas, the upper surface 20*e* of the finger-grip portion 20 remains flat and smooth.

Figure 2:
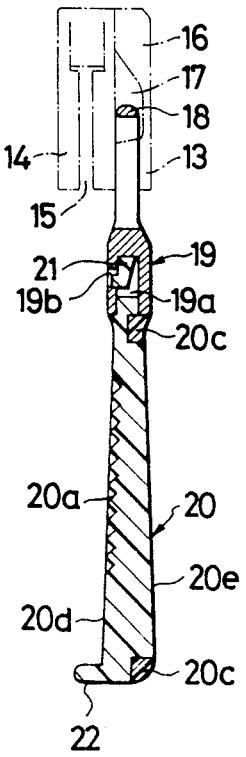
FIG. 2 is a longitudinal cross-sectional view taken on the line II—II of FIG. 1.
Figure 3:
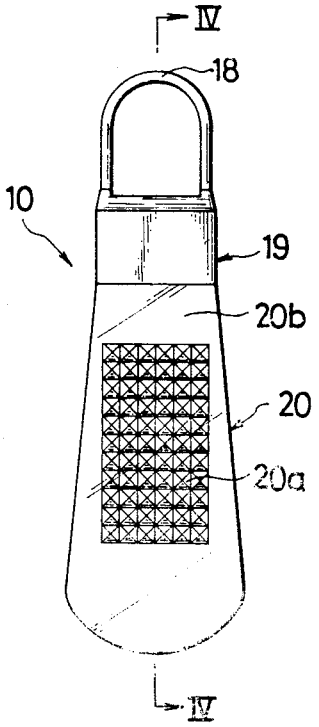
FIG. 3 is a plan view of a modified form of slider pull tab according to the invention.
Figure 4:
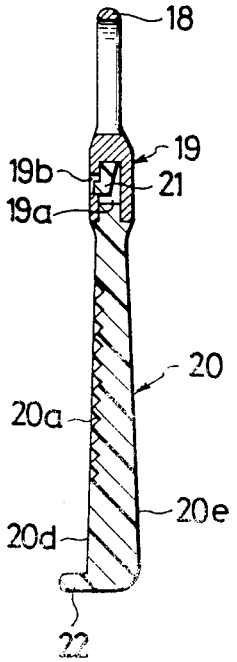
FIG. 4 is a longitudinal cross-sectional view taken on the like IV—IV of FIG. 3.

FIGS. 3 and 4 show a modified form of slider pull tab which is similar to the pull tab 10 of FIGS. 1 and 2 except for the exclusion of the non-transparent marginal region 20*c*. Again, the location of the transparent see-through regions 20*b* is quite optional and may be only at either of the upper and lower halves of the pull tab 20.

The transparent regions 20*b* may be colorless or colored whichever is more preferred in consideration of the appearance of a particular garment article on which the pull tab 10 is used.

Obviously, various modifications and variations of the present invention are possible in the light of the above teaching. It is therefore to be understood that within the scope of the appended claims the invention may be practiced otherwise than as specifically described.

What is claimed is:

1. A slider pull tab for a slide fastener, said pull tab comprising the following:

a clamper portion;

a finger-grip portion formed from a transparent material and including at least one transparent area;

a decorative region engraved in a lower surface of said transparent area; and means for connecting said clamper portion to said finger grip portion.

2. A slider pull tab according to claim 1 further including an opaque region formed on the upper surface of said finger-grip portion in surrounding relation to said decorative region and said transparent region.

3. A slide pull tab according to claim 1 wherein said synthetic resin is selected from the group of aryl, polycarbonate and nylon resins.

4. A slider pull tab according to claim 1 wherein said means is a snap lock prong formed at one end of said finger-grip portion and engageable in a window formed in the lower surface of said clamper portion.

5. A slider pull tab according to claim 1 further including a downwardly projecting lug formed at the other end of said finger-grip portion opposite to said clamper portion.

6. A slider pull tab according to claim 1, wherein said decorative region comprises a plurality of adjacent pyramidal figures arranged in a geometric pattern.

7. A slider pull tab for a slide fastener, said pull tab comprising the following:

a clamper portion;

a finger-grip portion formed from a transparent material and including at least one transparent area;

a decorative region engraved in a lower surface of said transparent area, said decorative region comprising a light-reflective stereoscopic section; and means for connecting said clamper portion to said finger grip portion.

* * * * *